US008476172B2

(12) United States Patent
Christof

(10) Patent No.: US 8,476,172 B2
(45) Date of Patent: Jul. 2, 2013

(54) KNITTED FABRIC THAT IS ELECTRICALLY CONDUCTIVE IN A BIAXIAL MANNER

(75) Inventor: Kurt Christof, Bayreuth (DE)

(73) Assignee: Medi GmbH & Co. KG, Bayreuth (DE)

( * ) Notice: Subject to any disclaimer, the term of this patent is extended or adjusted under 35 U.S.C. 154(b) by 681 days.

(21) Appl. No.: 11/657,137

(22) Filed: Jan. 23, 2007

(65) Prior Publication Data

US 2007/0298666 A1 Dec. 27, 2007

Related U.S. Application Data

(63) Continuation of application No. PCT/DE2005/001279, filed on Jul. 21, 2005.

(30) Foreign Application Priority Data

Jul. 24, 2004 (DE) ..... 10 2004 038 636

(51) Int. Cl.
*D04B 1/14* (2006.01)

(52) U.S. Cl.
USPC ..... 442/304; 442/2; 442/6; 66/169 R; 66/190; 66/202

(58) Field of Classification Search
USPC ..... 442/2, 6, 304; 66/169 R, 190, 202
See application file for complete search history.

(56) References Cited

U.S. PATENT DOCUMENTS

| | | | | |
|---|---|---|---|---|
| 4,653,473 | A | 3/1987 | Kempe | |
| 2003/0129905 | A1 * | 7/2003 | Dhawan et al. | 442/316 |
| 2006/0281382 | A1 * | 12/2006 | Karayianni et al. | 442/181 |

FOREIGN PATENT DOCUMENTS

| | | |
|---|---|---|
| DE | 2321852 | 11/1974 |
| DE | 9213884 | 3/1993 |
| DE | 19648544 | 5/1998 |
| DE | 19929077 | 12/2000 |
| DE | 20208592 | 9/2002 |
| DE | 20220752 | 3/2004 |
| EP | 0185480 | 6/1986 |
| EP | 0281526 | 9/1988 |
| EP | 0532468 | 3/1993 |
| JP | 61-202476 | 12/1986 |
| WO | 02061189 | 8/2002 |

OTHER PUBLICATIONS

Machine Translation DE9213884U1, pp. 1-2, Mar. 11, 1993.*

* cited by examiner

*Primary Examiner* — Elizabeth Cole
(74) *Attorney, Agent, or Firm* — Lucas & Mercanti, LLP

(57) ABSTRACT

An electrically conductive knitted fabric comprising stitched rows of an electrically non-conductive ground thread (1), and of stitched rows of an electrically conductive thread (2) placed therebetween. In addition, a number of rows of an electrically non-conductive ground thread can alternate with one or more rows of comprising electrically conductive thread. A connection overlapping the rows comprising electrically non-conducting thread exists in places between the rows comprising electrically conductive thread.

5 Claims, 2 Drawing Sheets

KNITTED FABRIC THAT IS ELECTRICALLY CONDUCTIVE IN A BIAXIAL MANNER

The present application is a continuation of International Application PCT/DE2005/001279, filed Jul. 21, 2005, which in turned claimed the priority of German Application No. DE 102004 034 636.6 filed Jul. 24, 2004. The priority of this International Application and the German application are hereby claimed.

The present invention relates to an electrically conductive knitted fabric consisting of mesh rows of an electrically non-conductive ground thread, as well as of mesh rows of an electrically conductive thread interposed therein between, it being also possible that a plurality of rows of the electrically non-conductive ground thread alternate with one or a plurality of rows of electrically conductive thread.

Such a knitted fabric is known from EP-A-0 281 526. The function of this knitted fabric is to dissipate electrostatic charge or to distribute it over the knitted fabric. EP-A-0 185 480 also accomplishes this objective by incorporating into an elastic knitted fabric threads made from fibers coated with metal for example and knit together with a ground thread. According to one embodiment, a knitted fabric is proposed one side of which consists of a non-conductive thread whilst the other side consists of the conductive thread. Electrically conductive threads are not only proposed for dissipating electrostatic charge, though. The document DE-A-199 29 077 for example proposes a silver fabric for shielding electric and high-frequency magnetic fields. The document DE-A-196 48 544 makes a similar proposal. U.S. Pat. No. 4,653,473 finally proposes fashioning garments from steel threads in order to reduce the pain in amputees commonly referred to as phantom limb pain or to reduce pain resulting from arthritis. The reduction of phantom limb pain is also an object of the document DE-U-202 08 592 which proposes a liner for stumps into which a matrix of electrically conductive material is incorporated. The preferred electrically conductive material is silver used as a thread or for coating the thread because it additionally exhibits antibacterial properties. Silver however is a very expensive material so that a knitted fabric exclusively made from silver threads of from silver-coated threads is not suited for wide and general application.

The use of metal threads, metal-coated threads or threads made from non-conductive material around which a metal thread is wound sets certain limits to the elasticity of the knitted fabric thus obtained. It is the object of the present invention to provide a knitted fabric containing threads made from an electrically conductive material that is biaxially conductive while exhibiting, if desired, high elasticity in at least one direction. Another object of the present invention is to provide a knitted fabric the biaxial electric conductivity of which may be achieved while significantly reducing the amount of silver in the knitted fabric.

This object is solved with the features of the characterizing portion of claim 1. Improved implementations and advantageous embodiments of the invention are comprised in the other claims.

In accordance with the invention, an electrically conductive knitted fabric consisting of mesh rows of an electrically non-conductive ground thread, as well as of mesh rows of an electrically conductive thread interposed therein between, it being possible that a plurality of rows of the electrically non-conductive ground thread alternate with one or a plurality of rows of electrically conductive thread, is characterized in that, between the rows of electrically conductive thread there is in places a connection overlapping the rows of electrically non-conductive thread. Metallized PA (polyamide) or PES (polyester) yarns or conductive polymers or an elastomer thread covered with these yarns are preferably used as the conductive thread. Among these, silver-coated PA is preferred because of its antibacterial properties and its good knittability. PA and PES, or elastomer threads covered with PA or PES are also preferred for use as the non-conductive yarn.

According to an embodiment of the invention, the connection is achieved by meshes of the respectively neighbouring rows of electrically conductive thread overlapping floating portions of the electrically non-conductive thread.

According to another embodiment of the invention, the connection occurs by bridging the electrically non-conductive thread by means of mesh, tuck, plating, floating or transfer of the electrically conductive thread.

According to a preferred embodiment of the invention, the connection points are offset with respect to each other; this offset may be regular. Thanks to this provision, the elasticity achieved in the knitting direction is largely just as high as if there were no overlapping connections between the rows consisting of electrically conductive material.

According to an advantageous embodiment of the invention, a floating or tucked weft yarn is incorporated into the knitted fabric. An elastomer thread may for example be chosen as the weft yarn for forming compression zones in bandages for example. Another example is the use of non-elastic thread, e.g., chenille yarn as the weft yarn, for incorporating non-elastic supporting zones acting as stabilizing zones in bandages.

The stretchability is at least 150% both in the knitting direction and transverse thereto. The stretchability was measured on a Dinema DSC measuring machine, version 2, with a load of 20 kg. Preferred embodiments of the knitted fabric achieve 300% transverse to the knitting direction and 320% in the knitting direction.

The specific surface resistivity of the non-stretched knitted fabric in the longitudinal and in the transverse direction is less than 10 ohm. The specific surface resistivity was measured on non-stretched planar knit samples of 150×150 mm. For this purpose, the opposing borders of the sample were clamped in the longitudinal and in the transverse direction using 4 tin-plated copper blocks dimensioned 150×12×5 mm so as to obtain a free width of 126 mm of the textile sample. In order to obtain therefrom the specific surface resistivity of the square sample, the value obtained is multiplied by 150/126. To measure the volume resistance, a pocket voltmeter of the brand Voltcraft, type VC333 was utilized.

The invention will be described in closer detail herein after with reference to the drawings. In said drawings.

Figure 1:
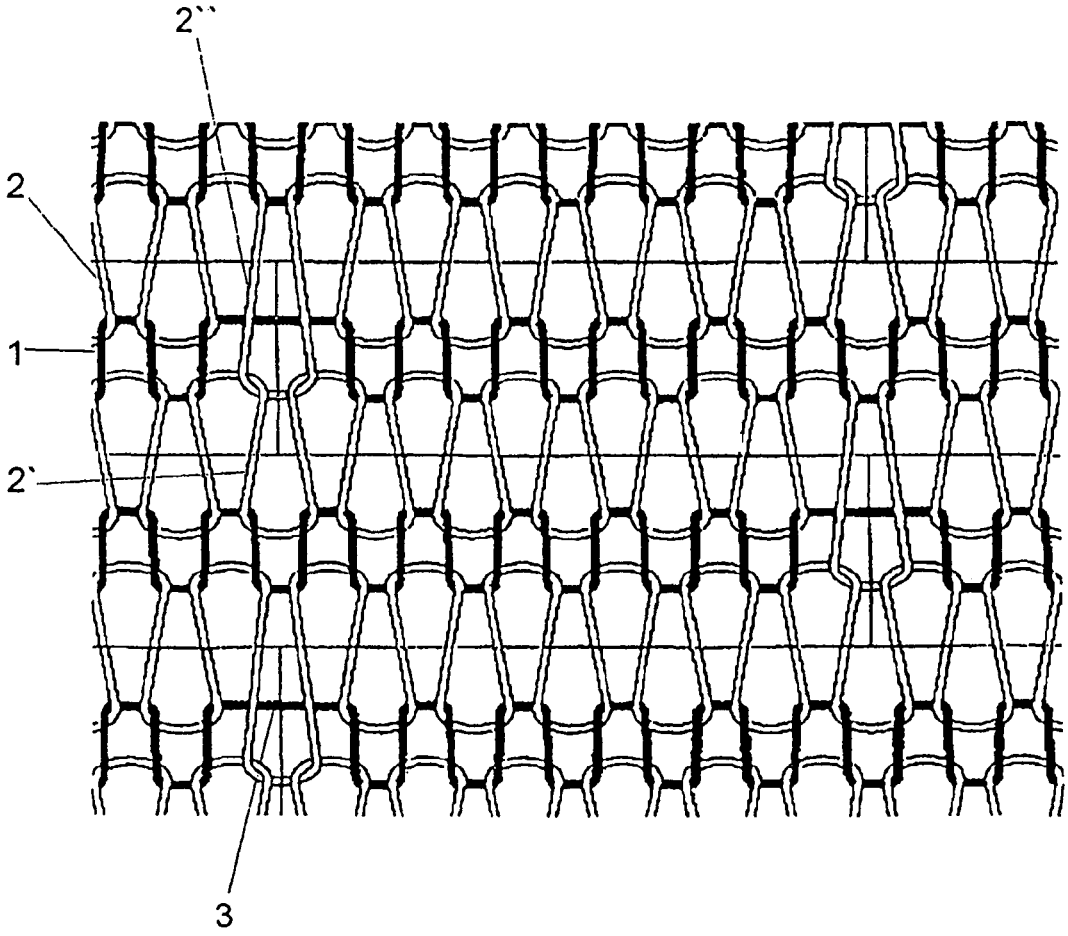
FIG. 1 shows a first implementation of a knitted fabric.

The knitted fabric according to FIG. 1 consists of rows of an electrically non-conductive yarn 1 between which rows of an electrically conductive yarn 2 are knitted. In order to connect the mesh rows of the electrically conductive yarn 2 and to thus allow for biaxial conductivity, the rows of the electrically non-conductive yarn (1) have floating portions 3 that are overlapped by enlarged meshes 2" of the electrically conductive yarn 2 knitted together with the next row of the electrically conductive yarn 2'.

Figure 2:
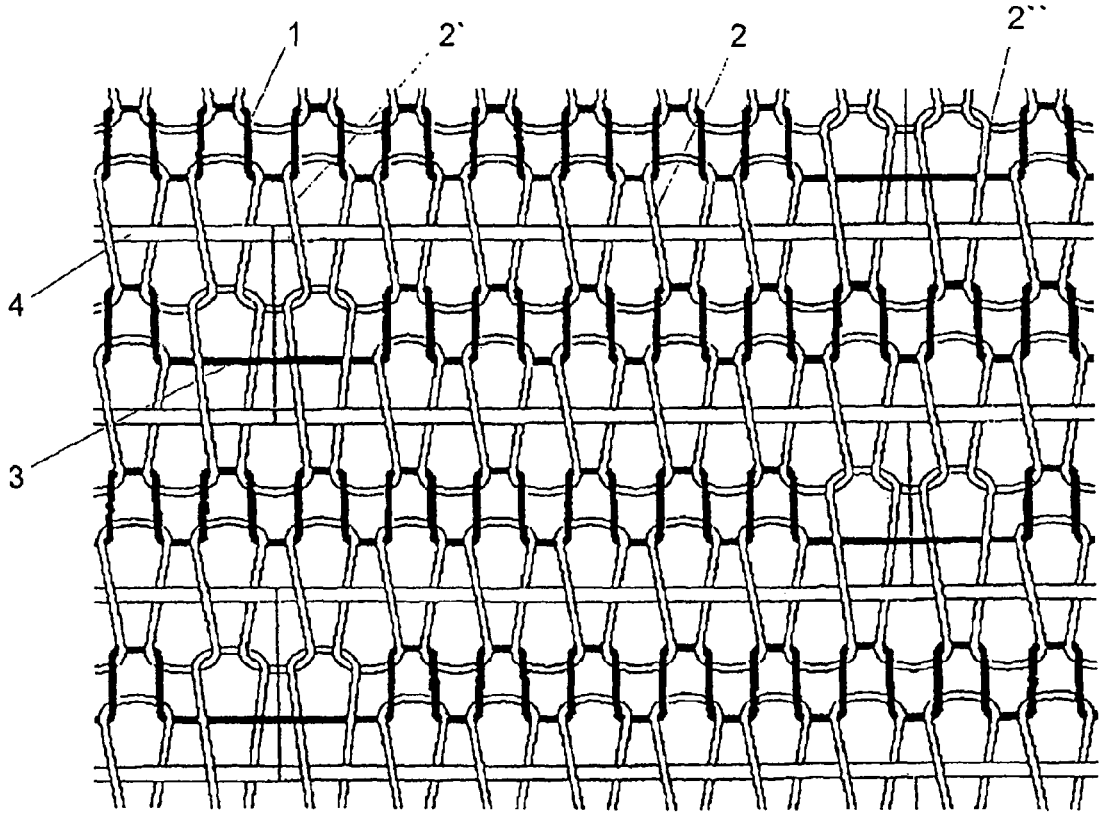
FIG. 2 shows a second implementation of a knitted fabric.

FIG. 2 shows an alternative knitted fabric in which the floating portions 3 of the electrically non-conductive yarn 1 extend over two meshes and two enlarged meshes 2" of the electrically conductive yarn accordingly extend as far as the next row of electrically conductive yarn 2. In this embodiment, a floating weft yarn 4 is further incorporated.

The invention claimed is:

1. A biaxially electrically conductive knitted fabric, comprising mesh rows of an electrically non-conductive ground thread, as well as of mesh rows of an electrically conductive thread interposed therein between, whereas a plurality of rows of the electrically non-conductive ground thread alternate with one or a plurality of rows of electrically conductive thread and wherein between the rows of electrically conductive thread, there is in some places a connection overlapping the rows of electrically non-conductive thread so as to form floating portions of the electrically non-conductive thread, wherein the connection is obtained by meshes of the respective neighbouring rows of the electrically conductive thread overlapping floating portions of the electrically non-conductive thread, and the stretchability is at least 150% in the knitting direction and transverse thereto.

2. The knitted fabric as set forth in claim 1, wherein the connection between neighbouring rows is offset.

3. The knitted fabric as set forth in claim 2, wherein the offset is regular.

4. The knitted fabric as set forth in claim 1, wherein a floating or tucked weft yarn is incorporated into the knitted fabric.

5. The knitted fabric as set claim 1, wherein the specific surface resistivity of the non-stretched knitted fabric in the longitudinal and in the transverse direction is less than 10 ohm.

* * * * *